US010351981B2

(12) United States Patent
Lonati et al.

(10) Patent No.: US 10,351,981 B2
(45) Date of Patent: Jul. 16, 2019

(54) FOOTING FOR CIRCULAR KNITTING MACHINES FOR HOSIERY OR THE LIKE

(71) Applicant: Lonati S.P.A., Brescia (IT)

(72) Inventors: Ettore Lonati, Botticino (IT); Fausto Lonati, Brescia (IT); Francesco Lonati, San Felice Del Benaco (IT)

(73) Assignee: Lonati S.P.A., Brescia (IT)

( * ) Notice: Subject to any disclaimer, the term of this patent is extended or adjusted under 35 U.S.C. 154(b) by 56 days.

(21) Appl. No.: 15/532,037

(22) PCT Filed: Dec. 1, 2015

(86) PCT No.: PCT/EP2015/078222
§ 371 (c)(1),
(2) Date: May 31, 2017

(87) PCT Pub. No.: WO2016/091662
PCT Pub. Date: Jun. 16, 2016

(65) Prior Publication Data

US 2017/0327981 A1 Nov. 16, 2017

(30) Foreign Application Priority Data

Dec. 9, 2014 (IT) ..... MI2014A002101

(51) Int. Cl.
*D04B 9/00* (2006.01)
*D04B 15/00* (2006.01)

(52) U.S. Cl.
CPC ..... *D04B 9/00* (2013.01); *D04B 15/00* (2013.01)

(58) Field of Classification Search
CPC ..... D04B 15/40; D04B 15/42; D04B 15/88; D04B 9/00; D04B 15/00
See application file for complete search history.

(56) References Cited

U.S. PATENT DOCUMENTS

| | | | | | |
|---|---|---|---|---|---|
| 476,515 | A | | 6/1892 | Brandley | |
| 731,097 | A | | 6/1903 | Carlsen | |
| 3,521,466 | A | * | 7/1970 | Tannert | D04B 9/20 66/125 R |
| 3,631,664 | A | | 1/1972 | MacKintosh | |
| 3,959,991 | A | * | 6/1976 | Brown | D04B 15/00 66/8 |
| 4,026,127 | A | * | 5/1977 | McCreary | D04B 15/48 226/183 |
| D246,244 | S | * | 11/1977 | Current | D15/66 |
| 4,363,225 | A | * | 12/1982 | Marchisio | D04B 15/42 242/131 |
| 4,512,373 | A | * | 4/1985 | Trost | B65H 49/32 139/101 |

(Continued)

OTHER PUBLICATIONS

Search Report from International PCT/EP2015/078222.

(Continued)

*Primary Examiner* — Danny Worrell
(74) *Attorney, Agent, or Firm* — Husch Blackwell LLC

(57) ABSTRACT

A footing for circular knitting machines for hosiery, comprising a supporting structure that comprises:
- uprights that are extended along substantially vertical directions;
- at least one tubular reinforcement element, which is connected rigidly to the uprights and mutually connects the uprights.

11 Claims, 7 Drawing Sheets

(56) References Cited

U.S. PATENT DOCUMENTS

| | | | | | |
|---|---|---|---|---|---|
| 4,580,418 | A | * | 4/1986 | Yang | D04B 15/94 66/147 |
| 4,718,253 | A | | 1/1988 | Lonati | |
| 4,730,466 | A | * | 3/1988 | Tenconi | D04B 35/10 242/131 |
| 4,765,155 | A | | 8/1988 | Pernick | |
| 4,977,758 | A | * | 12/1990 | Muir | D04B 9/065 66/125 R |
| 6,631,664 | B2 | | 10/2003 | Muller | |
| 6,983,625 | B2 | * | 1/2006 | Weber | D04B 15/00 66/8 |
| 7,310,976 | B1 | | 12/2007 | Renda | |

OTHER PUBLICATIONS

Italian Search Report and Written Opinion from IT MI20142101.
Columbian Patent Office Office Action No. 1155 related to Columbian Patent Application No. NC2017/0006848, dated Mar. 15, 2019 (7 pgs.)
English summary of Columbian Patent Office Office Action No. 1155 related to Columbian Patent Application No. NC2017/0006848, dated Mar. 15, 2019 (3 pgs.).

* cited by examiner

FOOTING FOR CIRCULAR KNITTING MACHINES FOR HOSIERY OR THE LIKE

The present invention relates to a footing for circular knitting machines for hosiery or the like.

As is known, circular knitting machines for hosiery are provided with a footing that constitutes the ground support for the machine and supports the textile head of the machine, which is constituted by the needle holder or by the single or double needle cylinder, which has a vertical axis and can rotate about its own axis with respect to the footing, and by the other elements required to form knitting, and the motors and actuators that actuate the various elements of the machine.

The footing performs the function of discharging to the ground all static and dynamic stresses caused by the weight of the elements that it supports and by the operation of the machine. In particular, in circular knitting machines with a single or double needle cylinder that can be actuated with an alternating rotary motion about its own axis, this alternating actuation generates torsion stresses on the footing that can be particularly onerous and difficult to contrast adequately.

Footings of currently commercially available hosiery knitting machines are constituted by plate-like elements made of sheet metal and/or die-cast elements that are mutually assembled so as to obtain the required strength.

The various types of hosiery knitting machine, by having different structures, have mutually different strength problems. Thus, for example, a single-cylinder circular machine has strength problems that are different from those of a double-cylinder circular machine. For this reason, various types of footings are commercially available as a function of the type of machine for which they are designed.

The wish to organize and, where possible, unify the production with the purpose of reducing both production costs and inventory management costs has given rise to the need to have a footing that can be used for different types of circular hosiery knitting machine.

The aim of the present invention is to meet this requirement, by providing a footing which, by way of its characteristics of strength and flexibility in use, can be used for various types of circular hosiery knitting machine and also for circular knitting machines or the like.

Within this aim, an object of the invention is to provide a footing that can be used both for single-cylinder circular machines and for double-cylinder circular machines.

Another object of the invention is to provide a footing that can be manufactured with competitive costs.

A further object of the invention is to provide a footing that facilitates maintenance interventions on the machine.

Another object of the invention is to provide a footing that offers adequate assurances of safety and reliability in use.

This aim, as well as these and other objects that will become better apparent hereinafter, are achieved by a footing for circular knitting machines for hosiery or the like, comprising a supporting structure, characterized in that said supporting structure comprises:

- uprights that are extended along substantially vertical directions;
- at least one tubular reinforcement element, which is connected rigidly to said uprights and mutually connects said uprights.

Further characteristics and advantages of the invention will become better apparent from the description of a preferred but not exclusive embodiment of the footing according to the invention, illustrated by way of nonlimiting example in the accompanying drawings, wherein.

Figure 1:
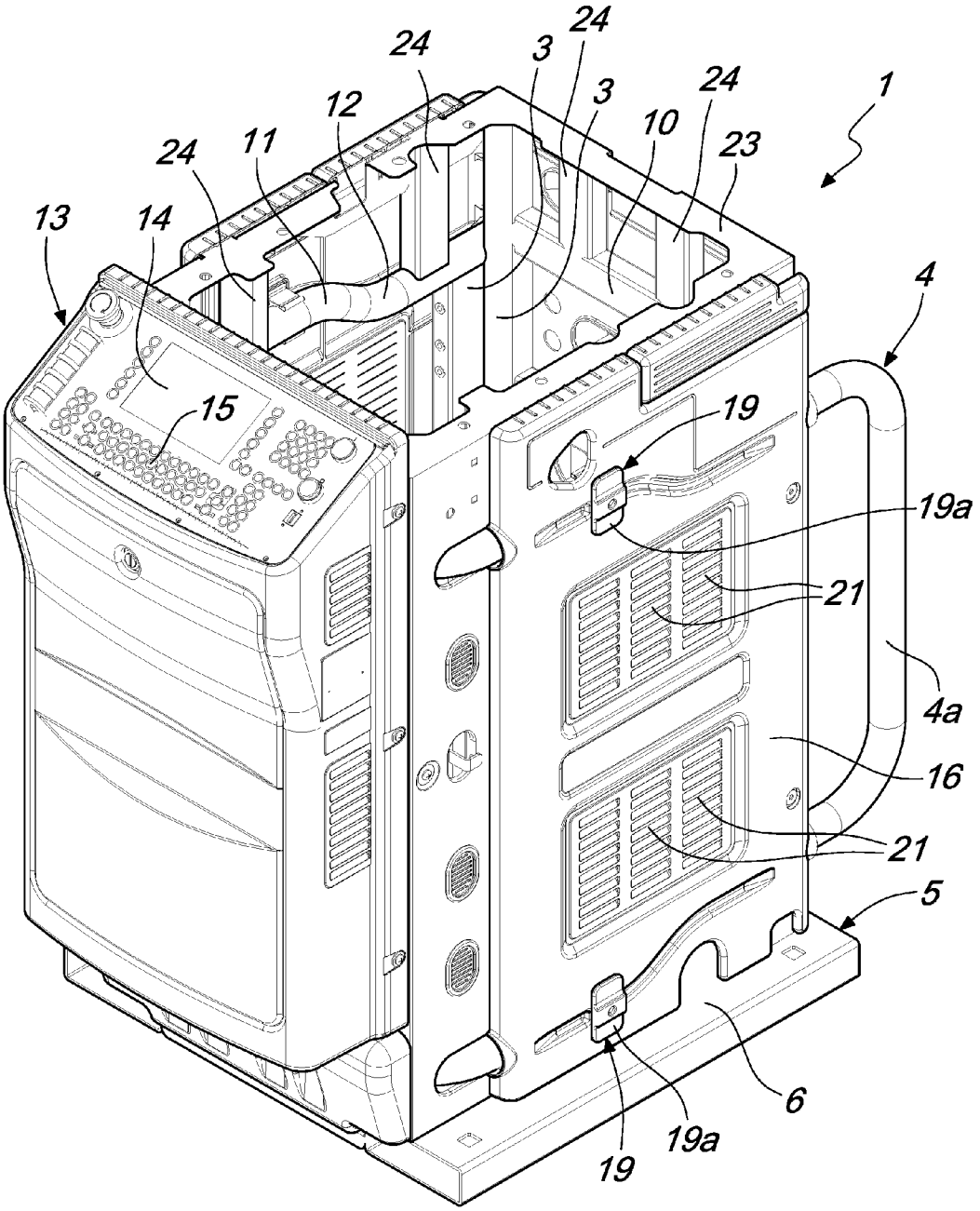
FIG. 1 is a perspective view of the footing according to the invention in the assembled condition.
Figure 2:
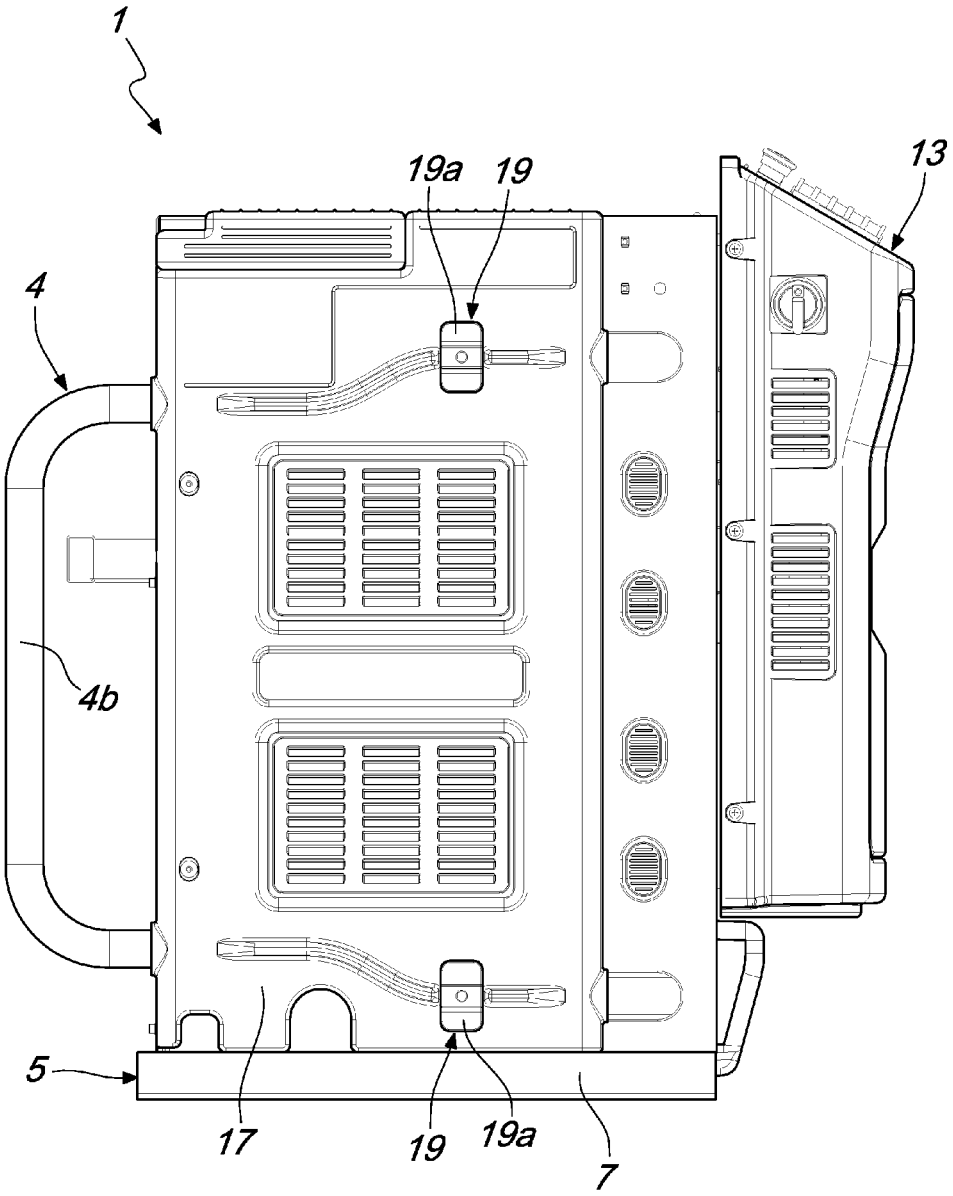
FIG. 2 is a side elevation view of the footing according to the invention.
Figure 3:
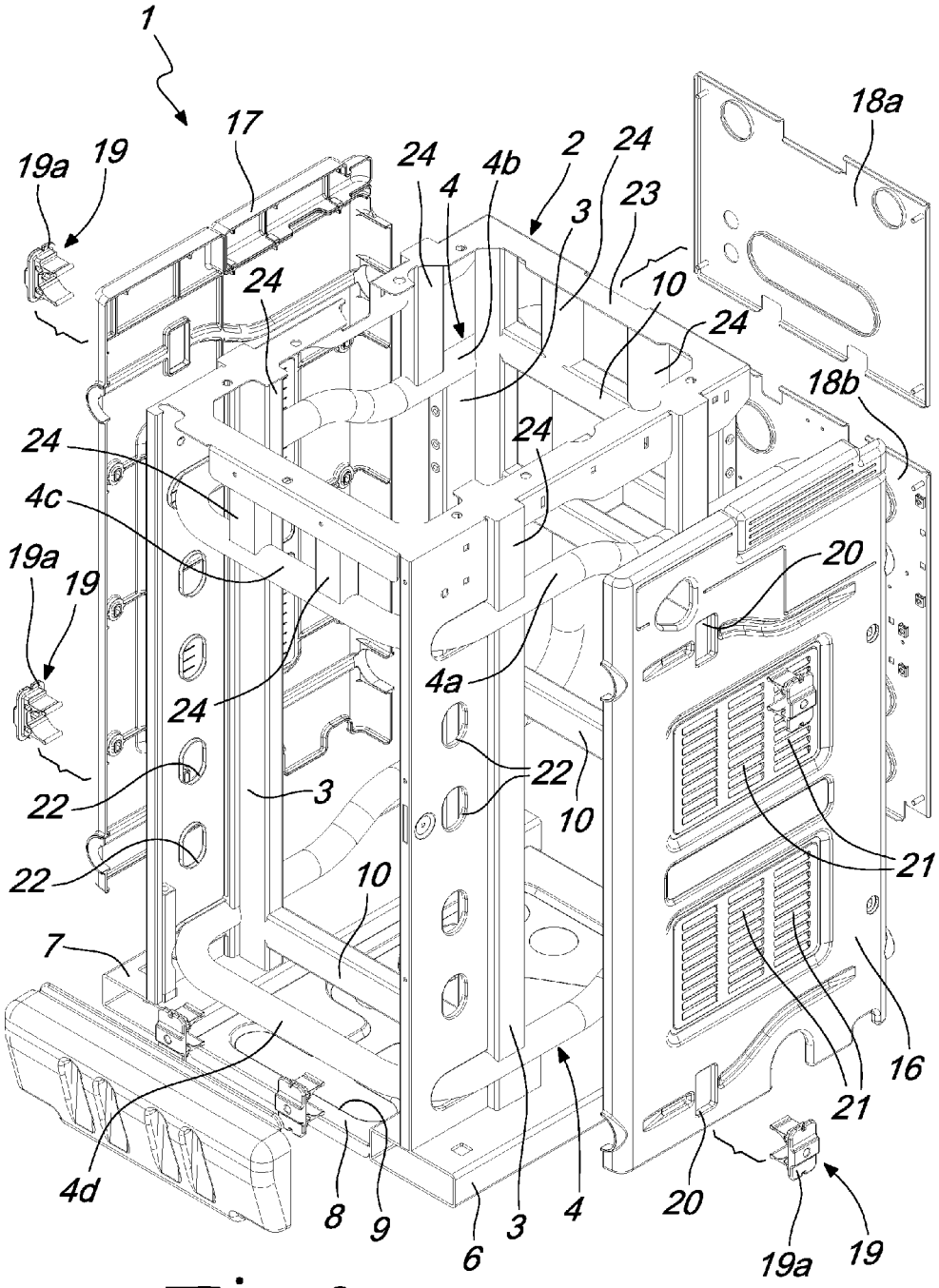
FIG. 3 is an exploded perspective view of part of the footing according to the invention.
Figure 4:
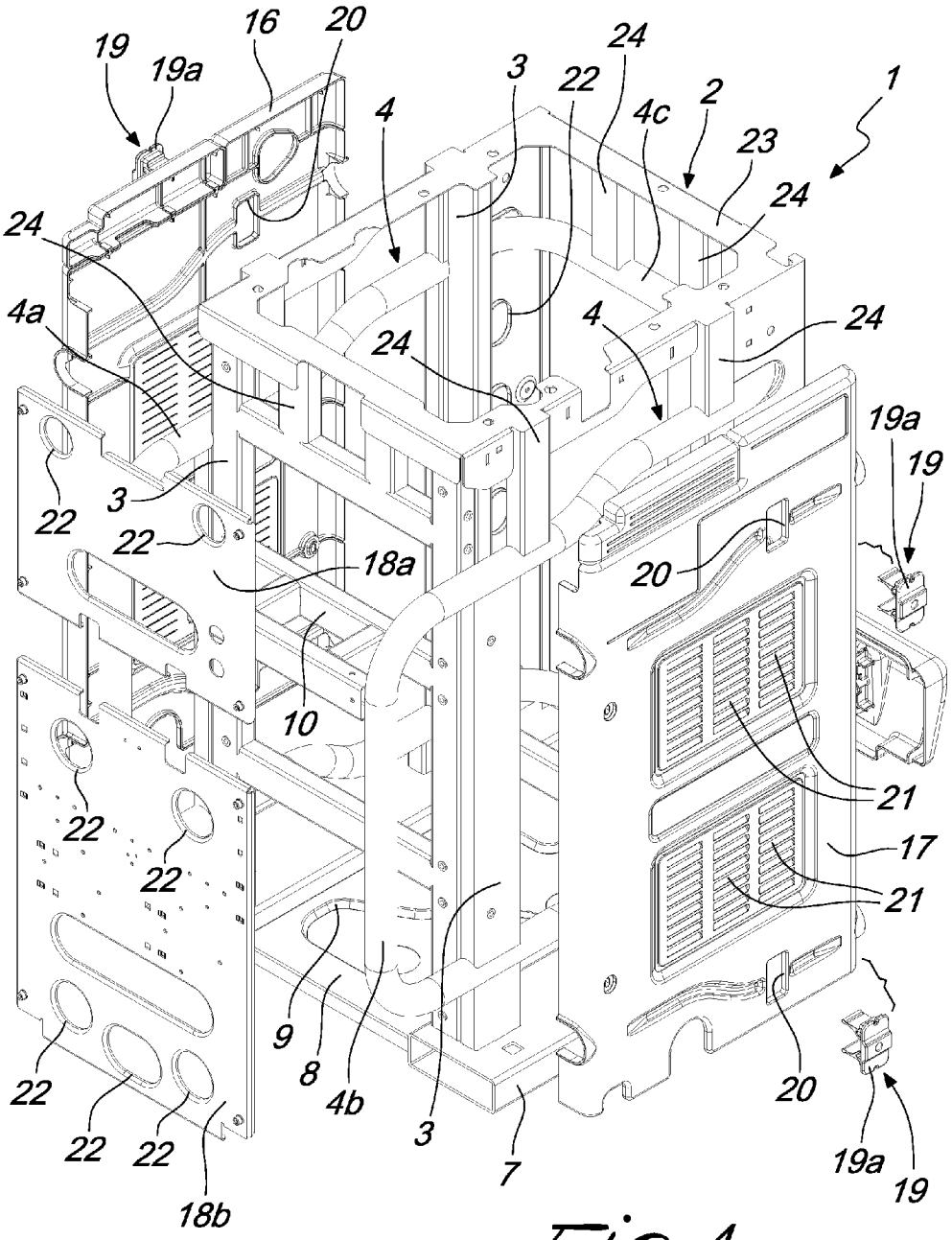
FIG. 4 is an exploded perspective view of part of the footing according to the invention, taken from a different angle with respect to FIG. 3.
Figure 5:
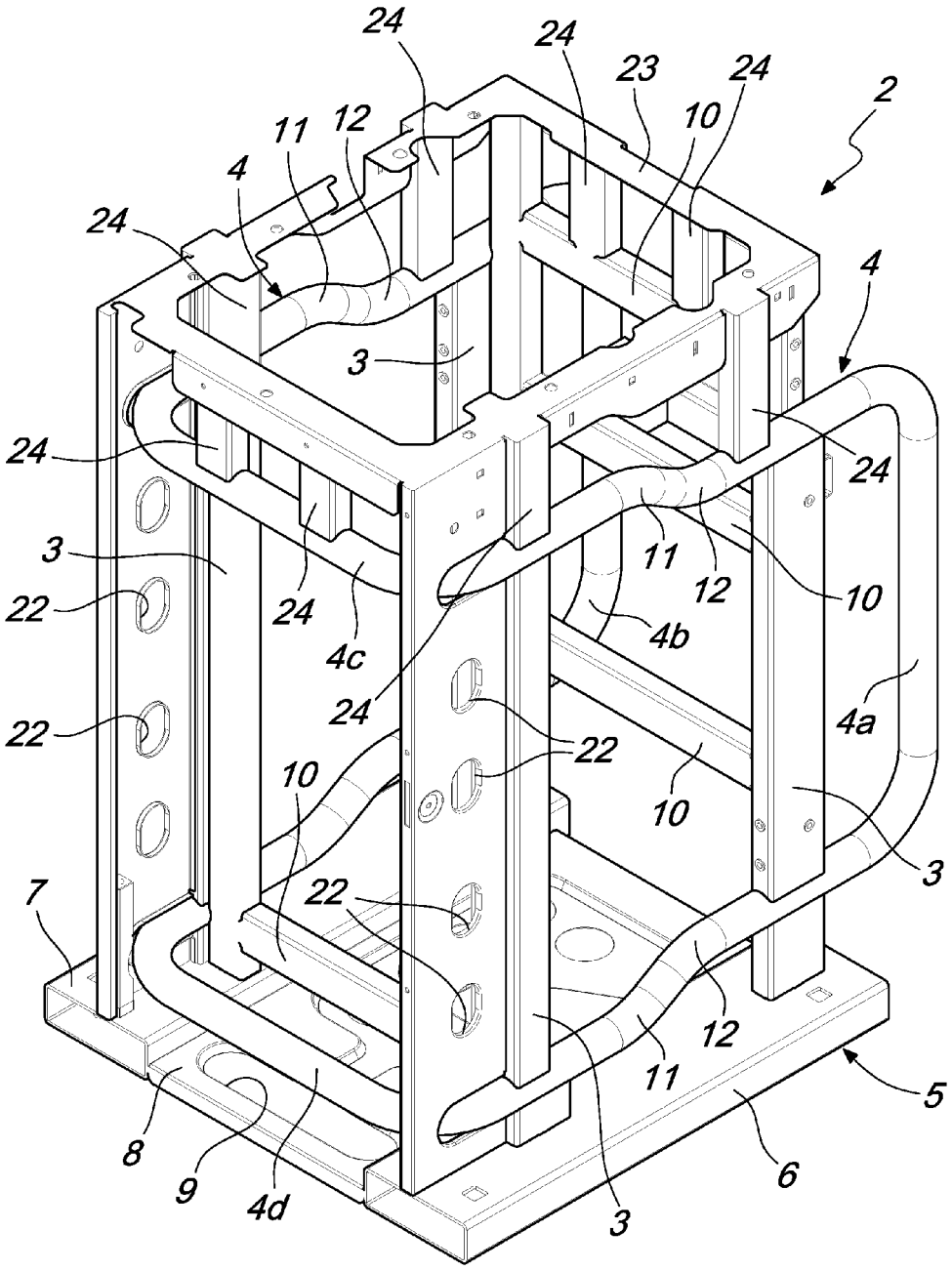
FIG. 5 is a perspective view of the supporting structure of the footing according to the invention.
Figure 6:
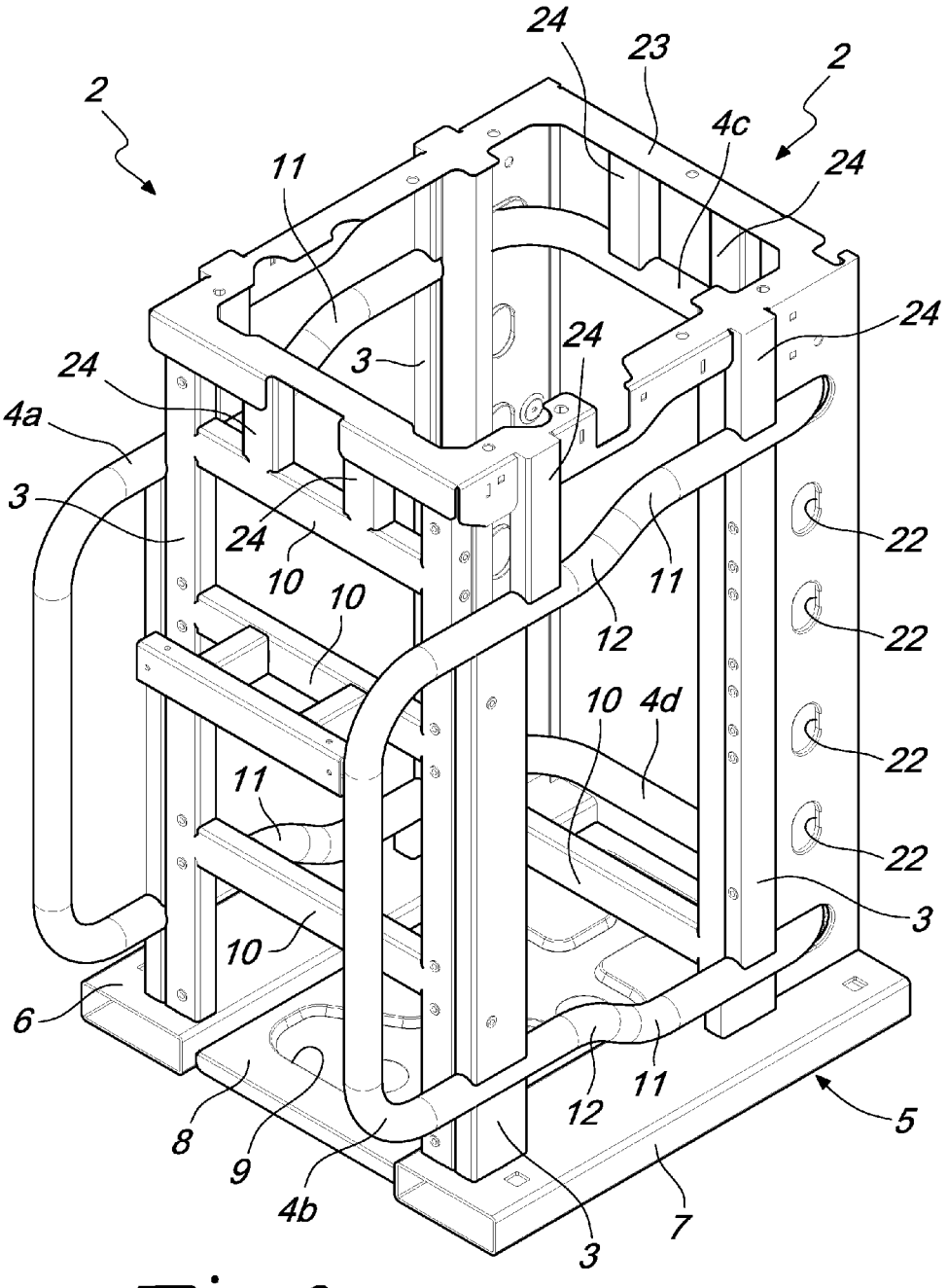
FIG. 6 is a perspective view of the supporting structure of the footing according to the invention, taken from a different angle with respect to FIG. 5.
Figure 7:
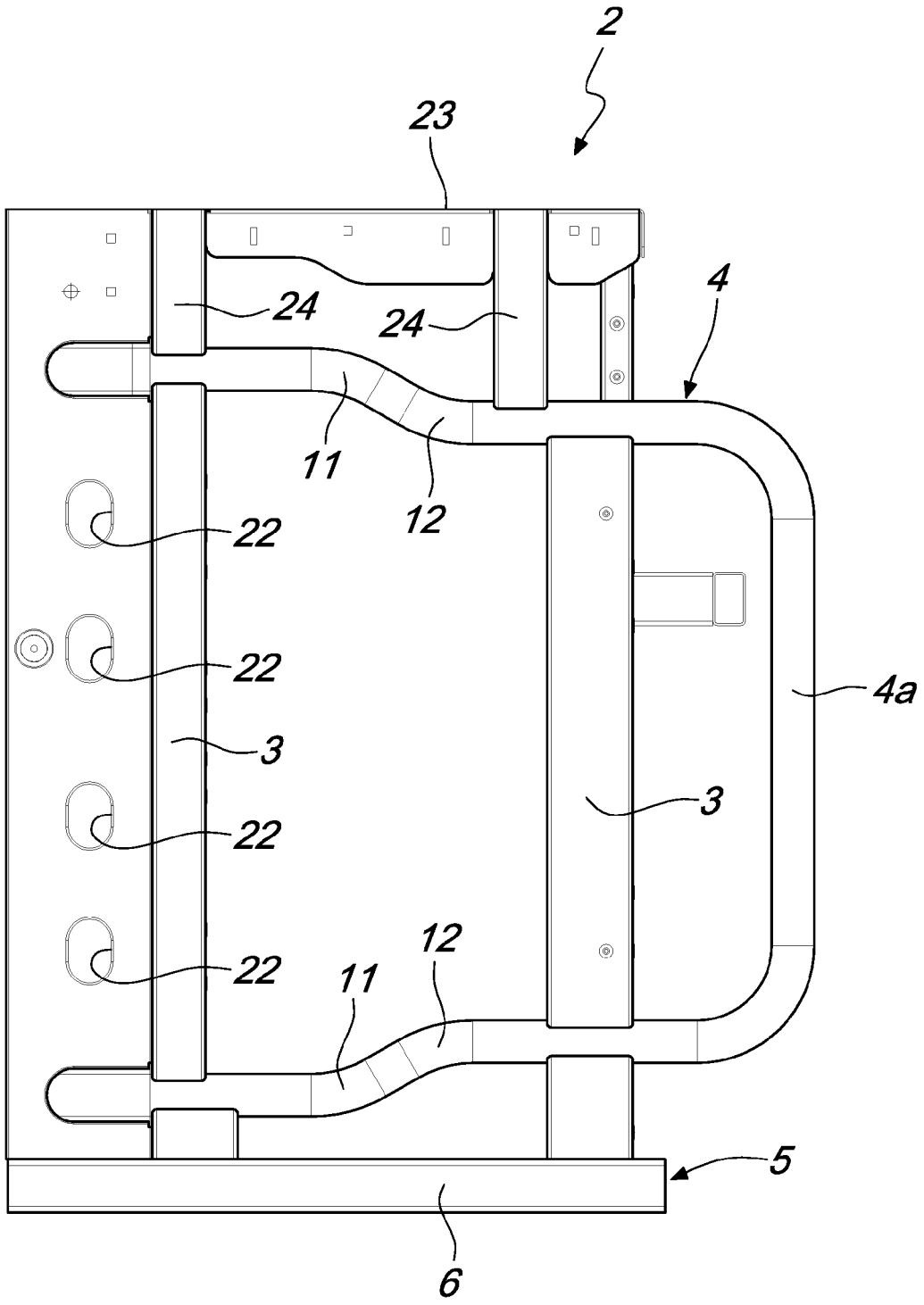
FIG. 7 is a side elevation view of the supporting structure of the footing according to the invention.

With reference to the figures, the footing for circular knitting machines for hosiery or the like, according to the invention, designated generally by the reference numeral 1, comprises a supporting structure 2, which, according to the invention, comprises uprights 3 that are extended along substantially vertical directions and at least one tubular reinforcement element 4, which is connected rigidly to the uprights 3 and mutually connects the uprights 3.

Conveniently, the uprights 3 are constituted by metallic tubular profiled elements and by elements made of bent sheet metal, preferably steel, which can be mutually assembled in a per se known manner, preferably by welding.

The uprights 3 extend from a base element 5 that has a rectangular plan shape and lies on a substantially horizontal plane. The uprights 3 are arranged substantially along the four vertical edges of an imaginary parallelepiped.

In greater detail, the base element 5 is composed of two tubular profiled elements 6, 7, which have a rectangular cross-section, are arranged proximate to the sides of the supporting structure 2 and are mutually connected by a metal plate 8 that is conveniently stiffened by means of a contoured drawn portion 9 in order to provide ribbing on the structure of the plate 8.

Preferably, a single tubular reinforcement element 4 is provided, which is closed onto itself and is fixed rigidly to the uprights 3.

Even more preferably, the tubular reinforcement element 4 is provided with two lateral portions 4*a*, 4*b*, which are arranged along the two opposite sides of the supporting structure 2. Each one of the two lateral portions 4*a*, 4*b* is C-shaped and mutually connects the two uprights 3 that are arranged along a same side of the supporting structure 2, both proximate to their lower ends and proximate to their upper ends.

The tubular reinforcement element 4 is provided with two front portions 4*c*, 4*d*, which are substantially horizontal and mutually parallel and mutually connect respectively the lower ends and the upper ends of the C-shape of the two lateral portions 4*a*, 4*b*.

Advantageously, the upper arm and preferably also the lower arm of the C-shape of each of the two lateral portions 4*a*, 4*b* have a bend 11 and a complementary bend 12 in an intermediate region of their extension, so as to reduce the distance between the upper arm and the lower arm of the C-shape on the front side in the direction of the rear side of the supporting structure 2.

In practice, in the supporting structure 2 of the footing according to the invention, the tubular reinforcement element 4 is in one piece with the uprights 3, achieving as a whole a strength that is capable of supporting correctly and without problems both the textile head, with the corresponding accessories, of both single-cylinder and double-cylinder circular hosiery knitting machines.

Conveniently, the uprights 3 can be mutually connected not only by the tubular reinforcement element 4 but also by transverse elements 10, also constituted by tubular profiles made of metal or bent metal plate, which further stiffen the supporting structure 2.

The uprights 3, at their upper end, are mutually connected by a frame 23 that lies on a substantially horizontal plane and to which a plate, usually provided in circular hosiery knitting machines around the needle cylinder is intended to be fixed. The frame 23 is preferably connected to the tubular reinforcement element 4 and/or to the transverse elements 10 by way of additional welded profiled elements 24, which contribute to increase the rigidity and overall strength of the supporting structure 2.

The footing according to the invention also comprises a front element 13, which can be associated with the front side of the supporting structure 2 and has a boxlike structure that is constituted by a molded covering made of technopolymer, mounted on a plate and intended to contain the instruments for the control and actuation of the machine.

As can be seen in FIG. 1, the front element 13 supports a monitor 14 and an interface keyboard 15 for controlling the machine. The molded covering is conveniently contoured in order to improve its use at the ergonomic level.

The footing according to the invention also comprises covering panels 16, 17, 18*a*, 18*b*, which can be associated, detachably for example by means of screws, with the supporting structure 2.

In the illustrated embodiment there are two lateral covering panels 16, 17 and there are, in combination with the screws or as an alternative to them, elements for the snap fixing 19 of the lateral covering panels 16, 17 to the supporting structure 2. The snap fixing elements 19 are constituted preferably by elastic U-bolts, which are shaped so as to partially wrap around the tubular reinforcement element 4 in preset regions. The elastic U-bolts 19 pass through holes 20 provided appropriately in the lateral covering panels 16, 17 and are provided with abutment wings 19*a*, the dimensions of which are such as to not pass through the holes 20, in order to retain the lateral covering panels 16, 17. In practice, the elastic U-bolts 19 can engage, by elastic reaction, the tubular reinforcement element 4, locking the lateral covering panels 16, 17 against the supporting structure 2.

The lateral covering panels 16, 17 are crossed by openings 21 with fins for the passage of the air for cooling the machine.

The footing according to the invention is completed by a pair of rear covering panels 18*a*, 18*b*, which are fixed detachably to the rear side of the supporting structure 2, for example by means of screws.

The part of the tubular reinforcement element 4 that is located at the rear can be used for the anchoring of accessories with which the machine is equipped, avoiding the use of expensive protruding plates to be screwed onto the footing, as instead occurs in many of the currently commercially available footings.

The lateral covering panels 16, 17, the front element 13 and optionally the rear covering panels 18*a*, 18*b* are preferably also made of molded technopolymer.

For the sake of completeness in description, it should be noted that the supporting structure 2 and the panels 16, 17, 18*a*, 18*b* can be provided with holes 22 for lightening or fixing or inspection or ventilation for components of the machine that they must support.

The supporting structure 2 of the footing according to the invention, thanks to the presence of the tubular reinforcement element 4, achieves a stability and resistance to stresses, both static and dynamic, also of a torsional type that derive from the alternating rotation of the single or double needle cylinder about its own axis, such as to allow the adoption of the footing according to the invention, not only for single-cylinder circular hosiery knitting machines, but also for double-cylinder circular hosiery knitting machines and for circular knitting machines.

Furthermore, the supporting structure of the footing 2, thanks to its shape, has large lateral windows, which are closed by the lateral covering panels 16, 17, which can be disassembled easily and quickly during maintenance interventions or inspections of the machine, making these interventions simple and quick to perform.

In practice it has been found that the footing according to the invention achieves fully the intended aim, since thanks to its particular supporting structure it has such a strength as to allow its use for a wide range of circular machines; in particular, the footing according to the invention can be used for single-cylinder circular hosiery knitting machines, for double-cylinder circular hosiery knitting machines and for circular knitting machines.

Another advantage of the footing according to the invention is that it renders the interventions for maintenance or inspection of the machine simpler and quicker.

A further advantage of the footing according to the invention is that it also uses materials that can be recycled easily at the end of the useful life of the machine.

The footing thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. MI2014A002101 (102014902315191) from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A footing for circular knitting machines for hosiery comprising a supporting structure, wherein said supporting structure comprises:

uprights that are extended along substantially vertical directions; and at least one tubular reinforcement element, which is connected rigidly to said uprights and mutually connects said uprights, said tubular reinforcement element is closed onto itself wherein said tubular reinforcement element is provided with two lateral portions that are arranged along two opposite sides of the supporting structure; each one of said two lateral positions being C-shaped and mutually connecting the two uprights arranged along a same side of the supporting structure, both proximate to their lower ends and proximate to their upper ends; said tubular reinforcement element having two front portions, which arranged on a front side of the supporting structure, are substantially horizontal and mutually parallel and mutually connect respectively the lower ends and upper ends of the C-shape of said two lateral portions.

2. The footing according to claim 1, wherein said uprights comprise tubular profiled elements or elements made of bent sheet metal.

3. The footing according to claim 1, wherein said uprights extend from a base element that has a rectangular plan shape and lies on a substantially horizontal plane.

4. The footing according to claim 1, wherein said uprights are connected to each other also by transverse elements.

5. The footing according to claim 3, wherein said base element comprises elements made of bent sheet metal or tubular profiled elements.

6. The footing according to claim 1, wherein an upper at in and/or a lower arm of the C-shape of each one of said lateral portions has a bend and a complementary bend in an intermediate region of its extension in order to decrease the distance between the upper arm and the lower arm of the C-shape on a front side toward a rear side of the supporting structure.

7. The footing according to claim 6, further comprising a front element that can be associated with the front side of said supporting structure and is provided with a box-like structure, constituted by a molded covering made of technopolymer mounted on a plate and ergonomically contoured in order to contain instruments for the control and actuation of the machine.

8. The footing according to claim 1, further comprising covering panels that are associated detachably with said supporting structure.

9. The footing according to claim 8, further comprising elements for snap fixing of at least part of said covering panels to said supporting structure.

10. The footing according to claim 9, wherein said snap fixing elements comprise elastic U-bolts that can be engaged by elastic reaction with said tubular reinforcement element and are provided with abutment wings in order to retain corresponding covering panels against said supporting structure.

11. The footing according to claim 8, wherein at least some of said covering panels are made of molded polymer.

* * * * *